US008900786B2

(12) United States Patent
Matsumoto et al.

(10) Patent No.: US 8,900,786 B2
(45) Date of Patent: Dec. 2, 2014

(54) IMAGE FORMING METHOD

(71) Applicant: Konica Minolta, Inc., Tokyo (JP)

(72) Inventors: Yoshiyasu Matsumoto, Tokyo (JP); Aya Shirai, Tokyo (JP); Ryuichi Hiramoto, Tokyo (JP); Taiki Amemiya, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/918,361

(22) Filed: Jun. 14, 2013

(65) Prior Publication Data

US 2013/0344432 A1 Dec. 26, 2013

(30) Foreign Application Priority Data

Jun. 20, 2012 (JP) ..... 2012-138837

(51) Int. Cl.

| | |
|---|---|
| ***G03G 15/08*** | (2006.01) |
| ***G03G 15/20*** | (2006.01) |
| ***G03G 15/01*** | (2006.01) |
| ***G03G 15/00*** | (2006.01) |
| ***G03G 13/08*** | (2006.01) |

(52) U.S. Cl.

CPC ..... *G03G 13/08* (2013.01); *G03G 15/2039* (2013.01); *G03G 15/0189* (2013.01); *G03G 15/6585* (2013.01); *G03G 2215/00805* (2013.01)

USPC ..... 430/123.55; 430/124.1; 430/125.32

(58) Field of Classification Search

CPC ... G03G 7/008; G03G 9/083; G03G 9/08737; G03G 9/08795; G03G 9/08755; G03G 9/0821; G03G 13/10; G03G 15/1605; G03G 7/004

USPC ..... 430/123.55, 124.1, 125.32

See application file for complete search history.

(56) References Cited

FOREIGN PATENT DOCUMENTS

| | | |
|---|---|---|
| JP | 2001-235892 | 8/2001 |
| JP | 2002-207334 | 7/2002 |
| JP | 2009-37102 A | 2/2009 |
| JP | 2010-156820 | 7/2010 |
| JP | 2011-150158 A | 8/2011 |

OTHER PUBLICATIONS

Japanese Office Action, Notification of Reason(s) for Refusal, Patent Application No. 2012-138837. Dispatch Date: Jul. 29, 2014 (4 pages).

English translation of Japanese Office Action, Notification of Reason(s) for Refusal, Patent Application No. 2012-138837. Dispatch Date: Jul. 29, 2014 (5 pages).

*Primary Examiner* — Hoa V Le

(74) *Attorney, Agent, or Firm* — Lucas & Mercanti, LLP

(57) ABSTRACT

A plurality of image parts, each having a different gloss level, are formed on the same recording material by electrophotographic technology. The plurality of gloss levels are visually recognized due to the plurality of image parts. The image forming method includes: developing electrostatic latent images on respective image carriers using a high softening point clear toner and a low softening point clear toner, to form a toner image by the high softening point clear toner and a toner image by the low softening point clear toner; transferring the toner images onto a recording material; and heat-fixing the toner image for low gloss and the toner image for high gloss transferred and formed onto the recording material, wherein a softening point Tm(a) of the high softening point clear toner and a softening point Tm(b) of the low softening point clear toner satisfy Tm(a)−Tm(b)>6° C.

15 Claims, 2 Drawing Sheets

IMAGE FORMING METHOD

CROSS REFERENCE TO RELATED APPLICATION

This Application claims the benefit of priority of Japanese Patent Application No. 2012438837 filed on Jun. 20, 2012, which application is incorporated herein by reference in its entirety.

TECHNICAL FILED

The present invention relates to an image forming method of electrophotographic technology.

BACKGROUND ART

A system to which electrophotographic technology is adopted has conventionally been used in a copying machine, a printer, a multifunction printer, a production printer and the like. In recent years, it is sometimes required to form various value-added images, for example, a see-through design image (watermark) using a clear toner.

By forming a plurality of image parts each having a different gloss level, a watermark can be recognized based on a difference in gloss level, not in color tone, among the plurality of image parts.

Also, in an image forming method in which a color toner is used, an image containing a photograph image part and a letter image part, for example, is formed by increasing the gloss level of the photograph image part and relatively decreasing the gloss level of the descriptive text (the letter image part). Accordingly, the photograph image part is vividly seen, while the descriptive text is easy to read. In this manner, it is sometimes required to form a plurality of image parts each having a different gloss level on the same image.

As a formation process of an image having varied gloss levels, there are known a process of, in case of using two or more types of toners, varying a laminating order or a toner attachment amount of toner images (see Patent Literature 1), a process of heat-fixing toners each having a varied melt viscosity (see Patent Literature 2) and the like.

However, in the above Patent Literature 1, the gloss level can be varied within some range from a certain predetermined gloss level, but the range of a gloss level that can be varied is up to 5 or so at 20° gloss. This range is not necessarily sufficient to form a gloss level difference among the image parts on the same image for exerting design features. Also, the above Patent Literature 2 discloses an image forming method of using two types of clear toners, which are a clear toner capable of forming a high gloss level image and a clear toner capable of forming a low gloss level image. In this case, one of the clear toners is selected in an alternative manner in order to simply form either the high gloss level image or the low gloss level image. Thus, there has been a problem that a plurality of image parts each having a different gloss level cannot be formed on the same image.

Also, there has been a problem that process conditions associated with image formation become complicated in both processes when attempting to realize the image forming method described above using the method disclosed in Patent Literature 1 or 2.

CITATION LIST

Patent Literature

Patent Literature 1: Japanese Patent Application Laid-Open No. 2011-150158

Patent Literature 2: Japanese Patent Application Laid-Open No. 2009-37102

SUMMARY OF INVENTION

Technical Problem

The present invention has been made in view of the foregoing circumstances and has as its object the provision of an image forming method in which a plurality of image parts each having a different gloss level can be easily formed on the same image by electrophotographic technology, and as a result, there is obtained a printed matter in which a plurality of gloss levels is visually recognized by the plurality of image parts on the same image so that design features are expressed.

Solution to Problem

An image forming method according to the present invention includes:

a developing step of developing an electrostatic latent image for a high softening point clear toner and an electrostatic latent image for a low softening point clear toner both being formed on an electrostatic latent image carrier, using a high softening point clear toner and a low softening point clear toner each having a different softening point, to form a toner image by the high softening point clear toner and a toner image by the low softening point clear toner;

a transferring step of transferring the toner image by the high softening point clear toner and the toner image by the low softening point clear toner onto a recording material via an intermediate transfer body to form a toner image for low gloss and a toner image for high gloss; and a fixing step of collectively heat-fixing the toner image for low gloss and the toner image for high gloss on the recording material, wherein a softening point Tm(a) of the high softening point clear toner and a softening point Tm(b) of the low softening point clear toner satisfy a relational formula (1) below:

$$Tm(a)-Tm(b)>6^\circ\ \mathrm{C}. \qquad \text{Relational formula (1):}$$

An image forming method according to the present invention includes:

a developing step of developing an electrostatic latent image for a high softening point clear toner, an electrostatic latent image for a low softening point clear toner and an electrostatic latent image for a color toner all being formed on an electrostatic latent image carrier, using a high softening point clear toner, a low softening point clear toner and a color toner each having a different softening point, to form a toner image by the high softening point clear toner, a toner image by the low softening point clear toner and a toner image by the color toner;

a transferring step of transferring the toner image by the high softening point clear toner, the toner image by the low softening point clear toner and the toner image by the color toner onto a recording material via an intermediate transfer body, to form a toner image for low gloss, a toner image for high gloss and a chromatic toner image; and a fixing step of collectively heat-fixing the toner image for low gloss, the toner image for high gloss and the chromatic toner image on the recording material, wherein a softening point Tm(a) of the high softening point clear toner, a softening point Tm(b) of the low softening point clear toner and a softening point Tm(c) of the color toner satisfy relational formulae (1) and (2) below:

$$Tm(a)-Tm(b)>6^\circ\ \mathrm{C}. \qquad \text{Relational formula (1):}$$

$$Tm(a)-3^\circ\ \mathrm{C.}>Tm(c)\geq Tm(b). \qquad \text{Relational formula (2):}$$

In the image forming method according to the present invention, in the transferring step the toner image by the low softening point clear toner, the toner image by the high softening point clear toner and the toner image by the color toner are preferably transferred on the intermediate transfer body in this order.

In the image forming method according to the present invention, it is preferred that each of the high softening point clear toner and the low softening point clear toner contains an external additive, and that a surface Si amount S(a) of the high softening point clear toner and a surface Si amount S(b) of the low softening point clear toner satisfy a relational formula (3) below:

$$S(a)<S(b). \quad \text{Relational formula (3):}$$

In the image forming method according to the present invention, a surface Si amount S(c) of the color toner preferably satisfies a relational formula (4) below:

$$S(c)\times 0.95<S(a)<S(b)<S(c)\times 1.05. \quad \text{Relational formula (4):}$$

In the image forming method according to the present invention, an amount of coarse particles having a particle diameter exceeding 10 μm in each of the high softening point clear toner and the low softening point clear toner is preferably not less than 0.01% by volume and not more than 5.0% by volume.

In the image forming method according to the present invention, an amount of coarse particles having a particle diameter exceeding 10 μm in the color toner is preferably not less than 0.01% by volume and not more than 4.0% by volume.

In the image forming method according to the present invention, the heat-fixing is preferably performed at a heating temperature of Tm(a)+80° C. to Tm(a)+100° C. in the fixing step.

In the image forming method according to the present invention, the intermediate transfer body preferably has a base and an elastic layer formed on the base.

In the image forming method according to the present invention, the elastic layer preferably includes at least a thermoplastic elastomer and an electrically conductive substance dispersed in the thermoplastic elastomer.

Advantageous Effects of the Invention

According to the image forming method of the present invention, a plurality of image parts each having a different gloss level can be simultaneously formed by a single heat-fixing process by using a high softening point clear toner and a low softening point clear toner each having a different softening point. As a result, the plurality of image parts enables easy formation of a printed matter in which a plurality of gloss levels is visually recognized on the same image so that design features are expressed.

DESCRIPTION OF EMBODIMENTS

The present invention will be specifically described below.

The image forming method according to the present invention includes: a developing step of developing an electrostatic latent image for a high softening point clear toner and an electrostatic latent image for a low softening point clear toner both being formed on an electrostatic latent image carrier, using a high softening point clear toner and a low softening point clear toner each having a different softening point, to form a clear toner image by the high softening point clear toner and a clear toner image by the low softening point clear toner; a transferring step of transferring the clear toner image by the high softening point clear toner and the clear toner image by the low softening point clear toner onto a recoding material via an intermediate transfer body, to form a toner image for low gloss (hereinafter also referred to as a "toner image for mat") and a toner image for high gloss (hereinafter also referred to as a "toner image for gloss"); and a fixing step of collectively heat-fixing the toner image for mat and the toner image for gloss transferred on the recording material, wherein a softening point Tm(a) of the high softening point clear toner and a softening point Tm(b) of the low softening point clear toner, each toner used in the developing step, satisfy a relational formula (1) below:

$$Tm(a)-Tm(b)>6^\circ\ \text{C}. \quad \text{Relational formula (1):}$$

By heat-fixing the toner image for mat and the toner image for gloss, there can be obtained a low gloss level image part (hereinafter also referred to as a "mat image part" and a high gloss level image part (hereinafter also referred to as a "gloss image part") having a gloss level higher than that of the mat image part, respectively.

In the image forming method described in detail below, formation processes of the mat image part, the gloss image part and a colored image part will be described.

First, an image forming apparatus used in the image forming method according to the present invention will be described.

<Image Forming Apparatus>

Figure 1:
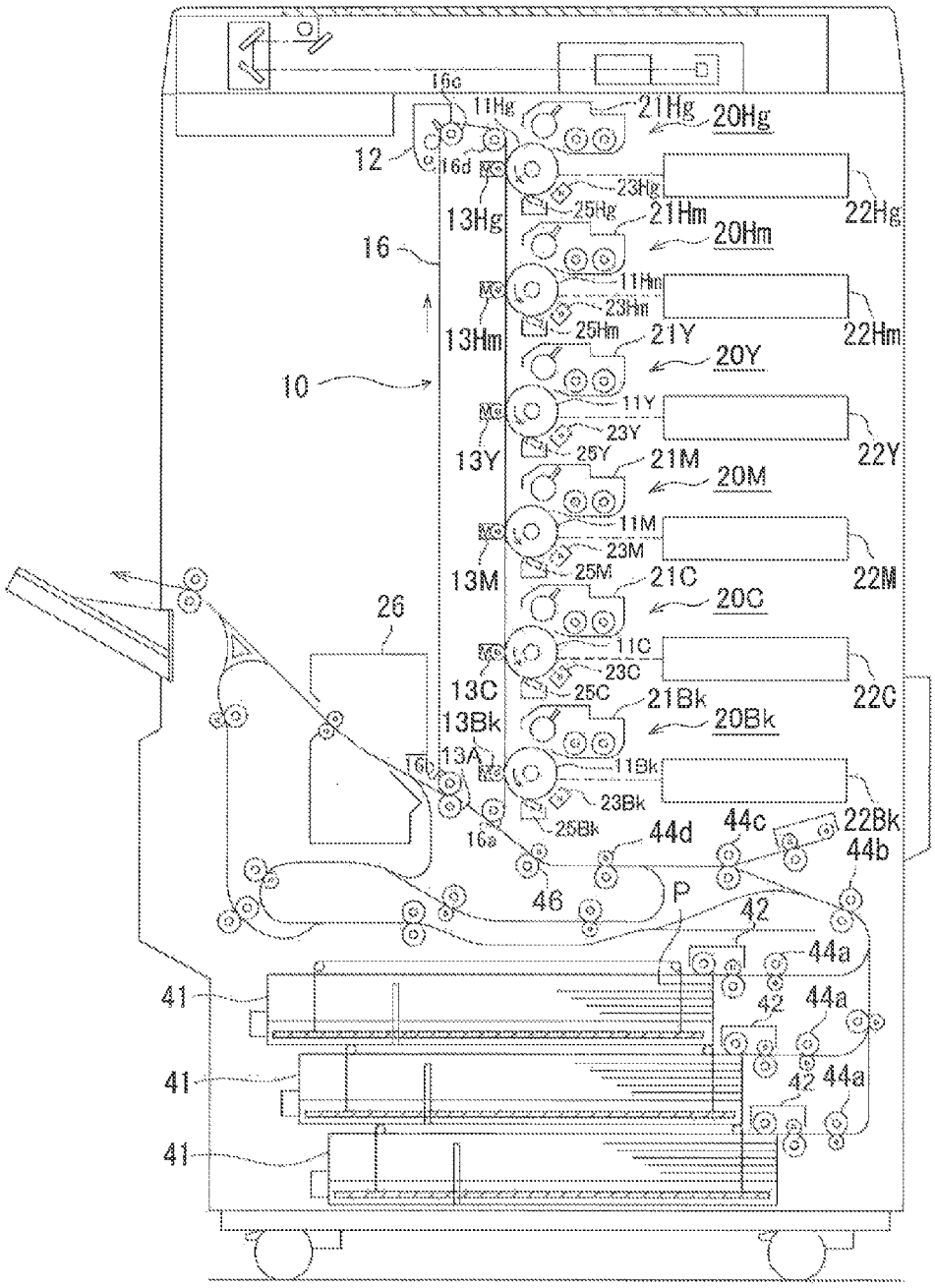
FIG. 1 is an explanatory sectional view illustrating an example of a structure of an image forming apparatus used in the image forming method according to the present invention.

FIG. 1 is an explanatory sectional view illustrating an example of a structure of an image forming apparatus used in the image forming method according to the present invention.

The image forming apparatus is a so-called tandem color image forming apparatus, and specifically includes, in the order arranged from the upstream along a moving direction of an intermediate transfer body 16: a gloss clear toner image forming part 20Hg that forms a clear toner image using a low softening point clear toner; a mat clear toner image forming part 20Hm that forms a clear toner image using a high softening point clear toner; color toner image forming parts 20Y, 20M, 20C and 20Bk each forming a color toner image using a color toner of yellow, magenta, cyan or black; an intermediate transfer part 10 that transfers toner images formed in the gloss clear toner image forming part 20Hg, the mat clear toner image forming part 20Hm and the color toner image forming parts 20Y, 20M, 20C and 20Bk onto a recording material P; and a fixing device 26 that performs a fixing treatment of heat-pressurizing the recording material P to fix the toner images.

In the color toner image forming part 20Y, toner image formation of yellow color is performed; in the color toner image forming part 20M, toner image formation of magenta color is performed; in the color toner image forming part 20C, toner image formation of cyan color is performed; and in the color toner image forming part 208*k*, toner image formation of black color is performed.

The gloss clear toner image forming part 20Hg and the mat clear toner image forming part 20Hm include, respectively: photoreceptors 11Hg and 11Hm as electrostatic latent image carriers; electric charging units 23Hg and 23Hm that provide potential uniformly on the surfaces of the photoreceptors 11Hg and 11Hm, respectively; exposing units 22Hg and 22Hm that form electrostatic latent images having desired shapes on the uniformly charged photoreceptors 11Hg and 11Hm, respectively; developing units 21Hg and 21Hm that deliver a low softening point clear toner and a high softening point clear toner onto the photoreceptors 11Hg and 11Hm to visualize the electrostatic latent images, respectively; and cleaning units 25Hg and 25Hm that recover residual toners on the photoreceptors 11Hg and 11Hm, respectively, after primary transfer was performed.

Also, the color toner image forming parts 20Y, 20M, 20C and 20Bk include, respectively: photoreceptors 11Y, 11M, 11C and 11Bk as electrostatic latent image carriers; electric charging units 23Y, 23M, 23C and 23Bk that provide potential uniformly on the surfaces of the photoreceptors 11Y, 11M, 11C and 11Bk, respectively; exposing units 22Y, 22M, 22C and 22Bk that form electrostatic latent images having desired shapes on the uniformly charged photoreceptors 11Y, 11M, 11C and 11Bk, respectively; developing units 21Y, 21M, 21C and 21Bk that deliver color toners onto the photoreceptors 11Y, 11M, 11C and 11Bk to visualize the electrostatic latent images respectively; and cleaning units 25Y, 25M, 25C and 25Bk that recover residual toners on the photoreceptors 11Y, 11M, 11C and 11Bk, respectively, after primary transfer was performed.

The intermediate transfer part 10 includes: an intermediate transfer body 16; primary transfer rollers 13Hg and 13Hm that transfer the respective clear toner images formed in the gloss clear toner image forming part 20Hg and the mat clear toner image forming part 20Hm onto the intermediate transfer body 16; primary transfer rollers 13Y, 13M, 13C and 13Bk that transfer the color toner images of respective colors formed in the color toner image formation parts 20Y, 20M, 20C and 20Bk, respectively, onto the intermediate transfer body 16; a secondary transfer roller 13A that transfers the respective clear toner images transferred onto the intermediate transfer body 16 by the primary transfer rollers 13Hg and 13Hm and the color toner images of respective colors transferred onto the intermediate transfer body 16 by the primary transfer rollers 13Y, 13M, 13C and 13Bk onto a recording material P; and a cleaning unit 12 that recovers a residual toner on the intermediate transfer body 16.

<Intermediate Transfer Body>

The intermediate transfer body 16 extends among a plurality of support rollers 16*a* to 16*d* to be rotatably supported, and has an endless belt-like shape.

The intermediate transfer body 16 preferably has a base and an elastic layer formed on the base.

Since the intermediate transfer body 16 has the elastic layer, the intermediate transfer body 16 is deformed by received stress, so that following properties thereof to a toner image are improved. Accordingly, transfer properties of a toner are increased.

A material for forming the elastic layer of the intermediate transfer body 16 is not particularly limited, and an elastic material such as a certain rubber material or thermoplastic elastomer can be used.

As examples of the rubber material, may be mentioned styrene-butadiene rubber (SBR), high styrene rubber, polybutadiene rubber (BR), polyisoprene rubber (IIR), ethylene-propylene copolymers, nitrilebutadiene rubber, chloroprene rubber (CR), ethylene-propylene-diene rubber (EPDM), butyl rubber, silicone rubber, fluorine rubber, nitrile rubber, urethane rubber, acrylic rubber (ACM, ANM), epichlorohydrin rubber and norbornene rubber. These may be used either singly, or in any combination thereof.

As examples of the thermoplastic elastomer, may be mentioned polyester-based elastomer, polyurethane-based elastomer, styrene-butadiene triblock-based elastomer and polyolefin-based elastomer. These may be used either singly, or in any combination thereof.

Also, the elastic layer may be formed using a combined material of a resin material constituting the base and the above-mentioned elastic material.

For example, when using silicone rubber as the above-mentioned rubber material, a polyorganosiloxane composition containing a vinyl group can be used as the silicone rubber. As specific examples of the silicone rubber, may be mentioned a two-part liquid silicone rubber capable of curing by an addition reaction catalyst and a heat curing silicone rubber capable of curing by a curing agent made of peroxide.

Also, the elastic layer may contain, as additives, a variety of compounding agents such as a filler, an extender filler, a curing agent, a coloring agent, an electrically conductive substance, a heat resistant agent and a pigment.

Although the plasticity of the elastic layer material depends on the added amount of the compounding agent and the like, the plasticity prior to curing is preferably equal to or lower than 120 in the above-described silicone rubber.

The elastic layer preferably includes an electrically conductive substance dispersed in the elastic material. In this case, the electric resistance value (volume resistivity) is preferably $10^5$ to $10^{11}$ Ω·cm.

As examples of the electrically conductive substance, may be mentioned carbon black, zinc oxide, tin oxide and silicon carbide. As the carbon black, a neutral carbon black or an acidic carbon black can be used.

The content of the electrically conductive substance also depends on the type of the electrically conductive substance to be used. However, the content may be an amount that allows the volume resistivity and the surface resistance value of the elastic layer to fall in a predetermined range, and is usually 10 to 20 parts by mass, preferably 10 to 16 parts by mass per 100 parts by mass of the elastic material.

The elastic layer can be produced by a known coating process, such as the dipping coating disclosed in Japanese Patent Application Laid-Open No. 2006-255615, the circular amount regulating coating disclosed in Japanese Patent Application Laid-Open No. Hei. 10-104855, and the ring coating method disclosed in Japanese Patent Application Laid-Open No. 2007-136423. Alternatively, the elastic layer can be produced by combining the dipping coating and the circular amount regulating coating to provide a coating film. However the coating process for producing an elastic layer is not limited to these coating processes.

The thickness of the elastic layer is preferably 50 to 500 μm, more preferably 100 to 300 μm.

In the image forming apparatus, there are provided, along a circulation direction of the intermediate transfer body 16, the gloss clear toner image forming part 20Hg that forms a clear toner image using a low softening point clear toner, the mat clear toner image forming part 20Hm that forms a clear toner image using a high softening point clear toner, the color toner image forming part 20Y that forms a yellow toner image, the color toner image forming part 20M that forms a magenta toner image, the color toner image forming part 20C that forms a cyan toner image and the color toner image forming part 20Bk that forms a black toner image, in this order.

The fixing device 26 includes a heat-fixing belt contacting one side of the recording material P on which toner images are formed, and a pressurizing roller provided in pressure contact with the heat-fixing belt and having an elastic layer. A nip part is formed by a pressure contact part between the heat-fixing belt and the pressurizing roller.

<Image Forming Method>

The image forming method according to the present invention will be specifically described below with reference to the above-described image forming apparatus.

Developing Step:

First, in the gloss clear toner image forming part 20Hg, the mat clear toner image forming part 20Hm and the color toner image forming parts 20Y, 20M, 20C and 20Bk, the surfaces of the photoreceptors 11Hg, 11Hm, 11Y, 11M, 11C and 11Bk are electrically charged by the electric charging units 23Hg, 23Hm, 23Y, 23M, 23C and 23Bk, respectively. Then, the surfaces are subjected to light exposure by the exposing units 22Hg, 22Hm, 22Y, 22M, 22C and 22Bk to form an electrostatic latent image for a low softening point clear toner, an electrostatic latent image for a high softening point clear toner and electrostatic latent images for color toners of respective colors. The electrostatic latent image for a low softening point clear toner, the electrostatic latent image for a high softening point clear toner and the electrostatic latent images for color toners of respective colors are developed by the developing units 21Hg, 21Hm, 21Y, 21M, 21C and 21Bk to form a clear toner image by the low softening point clear toner, a clear toner image by the high softening point clear toner and color toner images of respective colors.

Transferring Step:

Next, the clear toner image by the low softening point clear toner, the clear toner image by the high softening point clear toner and the color toner images of respective colors are transferred on the intermediate transfer body 16 in this order by the primary transfer rollers 13Hg, 13Hm, 13Y, 13M, 13C and 13Bk. In this manner, the toner images are superimposed over one another on the intermediate transfer body 16.

On the other hand, the recording material P contained in a paper feeding cassette 41 is fed by means of a paper feeding and delivering unit 42, and delivered by means of a plurality of paper feeding rollers 44*a*, 44*b*, 44*c*, 44*d*, and a resist roller 46. Then, the toner images on the intermediate transfer body 16 are collectively transferred onto the recording material P by the secondary transfer roller 13A.

In the transferring step, the black toner image, the cyan toner image, the magenta toner image, the yellow toner image, the clear toner image by the high softening point clear toner and the clear toner image by the low softening point clear toner are transferred on the recording material P in this order. That is, the clear toner image by the low softening point clear toner is preferably present in a layer above any other toner images.

In order to obtain a desired gloss level in the resultant gloss image part, the clear toner image by the low softening point clear toner is required to be present in a layer above any other toner images on the recording material P.

Also, in general, the clear toner image by the high softening point clear toner is preferably present in a layer above the color toner images of respective colors on the recording material P. However, this is not mandatory. For example, when intending to lower the gloss level of a recording material P, visual quality can be improved in some cases by placing the clear toner image by the high softening point clear toner in a layer below the color toner images of respective colors. Thus, the clear toner image by the high softening point clear toner may be placed in a layer below the color toner images of respective colors.

The color toner images stacked with the clear toner image by the low softening point clear toner or the clear toner image by the high softening point clear toner may be a color toner image of a single color itself, or a stack of color toner images of several colors.

On the recording material P, a portion containing the clear toner image by the high softening point clear toner and having a toner attachment amount of the high softening point clear toner of not less than 95% by mass when the total amount of the high softening point clear toner and the low softening point clear toner is 100% by mass becomes a toner image for mat; and a portion containing the clear toner image by the low softening point clear toner and having a toner attachment amount of the low softening point clear toner of not less than 95% by mass when the total, amount of the high softening point clear toner and the low softening point clear toner is 100% by mass becomes a toner image for gloss.

The toner image for mat also includes an image in which the color toner images are stacked above or below the clear toner image by the high softening point clear toner. The toner image for gloss also includes an image in which the color toner images are stacked below the clear toner image by the low softening point clear toner.

By forming the toner image for mat having the color toner images and the toner image for gloss having the color toner images described above, a color watermark can be formed.

Also, on the recording material P, a portion which does not contain both the clear toner image by the high softening point clear toner and the clear toner image by the low softening point clear toner and is formed only with the color toner images by the color toners becomes a chromatic toner image.

Here, the chromatic toner image may be a color toner image of a single color itself, or a stack of color toner images of several colors.

Each of the toner attachment amounts of the low softening point clear toner, the high softening point clear toner and the color toners of respective colors is preferably an amount capable of covering a region in which the gloss image part and the mat image part are formed on the recording material P to a degree which allows the formed gloss image part and mat image part to impart uniform gloss. Also, in view of the inhibition of transfer unevenness, each of the amounts is specifically preferably 4 $g/m^2$ to 8 $g/m^2$.

The thickness of each of the toner image for mat, the toner image for gloss and the chromatic toner image on the recording material P is preferably substantially equal to one another, and is preferably, for example, 2 to 50 μm.

In the image forming method according to the present invention, the gloss image part, the mat image part and the colored image part may be formed in a contiguous region or in a separate region on the same recording material.

Fixing Step:

After the transferring step, the toner image for mat, the chromatic toner image and the toner image for gloss transferred onto the recording material P are pressurized and heated in the fixing device 26 for fixing. Thus, the mat image part, the colored image part and the gloss image part are simultaneously formed.

The conditions of the fixing treatment by the fixing device 26 are not limited as long as the fixability of a high softening point clear toner can be sufficiently obtained. Specifically, the heating temperature may be 150 to 230° C., preferably 160 to 190° C., and the nip time may be 10 to 300 msec, preferably 20 to 70 msec. The heating temperature is preferably set at the softening point of a high softening point clear toner+90° C. as a rough standard, in order to melt two types of clear toners each having a different softening point.

The heating temperature in the fixing device 26 is defined as a surface temperature of a heat-fixing belt being in contact with the toner image for mat, the toner image for gloss and the chromatic toner image transferred onto the recording material P.

The surface temperature of the heat-fixing belt can be measured by bringing a thermistor into contact with the surface of the heat-fixing belt.

Also, the nip time is calculated by:

delivering-direction length (mm) of nip part/linear velocity (m/sec)×1,000.

After the clear toner image by the low softening point clear toner, the clear toner image by the high softening point clear toner and the color toner images of respective colors were transferred from the photoreceptors 11Hg, 11Hm, 11Y, 11M, 11C and 11Bk onto the intermediate transfer body 16, the toner residues remained on the photoreceptors 11Hg, 11Hm, 11Y, 11M, 11C and 11Bk are removed by the cleaning units 25Hg, 25Hm, 25Y, 25M, 25C and 25Bk, respectively. Then, the photoreceptors 11Hg, 11Hm, 11Y, 11M, 11C and 11Bk are provided for next formation of a clear toner image by a low softening point clear toner, a clear toner image by a high softening point clear toner and color toner images of respective colors.

On the other hand, after the clear toner image by the low softening point clear toner, the clear toner image by the high softening point clear toner and the color toner images of respective colors were transferred from the intermediate transfer body 16 onto the recording material P by the secondary transfer roller 13A, the toner residues remained on the intermediate transfer body 16 are removed by the cleaning unit 12. Then, the intermediate transfer body 16 is provided for next intermediate transfer of a clear toner image by a low softening point clear toner, a clear toner image by a high softening point clear toner, or color toner images of respective colors.

<High Softening Point Clear Toner and Low Softening Point Clear Toner>

Each of the high softening point clear toner and the low softening point clear toner used in the image forming method according to the present invention is made of toner particles containing a binder resin and being used for the development of an electrostatically charged image, and may contain, as necessary, a mold release agent, a charge control agent and the like.

Here, the clear toner is defined as a toner without positively containing a coloring agent such as a pigment and a dye. However, the toner containing a very small amount of a coloring agent such as a pigment and a dye and the toner containing a colored binder resin, wax and external additive, for example, can also be considered as the clear toner, as long as the color of the fixed layer obtained by the heating and pressurizing treatment is not recognized due to the effect of light absorption or light scattering.

<Thermoplastic Resin>

The binder resin constituting the high softening point clear toner and the low softening point clear toner used in the image forming method according to the present invention preferably includes a thermoplastic resin. However, a thermal cross-linking resin or the like may also be used.

As examples of the thermoplastic resin, may be specifically mentioned vinyl-based resins such as styrene-based resins, (meth)acrylic-based resins, styrene-(meth)acrylic-based copolymer resins and olefin-based resins and various known thermoplastic resins such as polyester-based resins, polyamide-based resins, polycarbonate-based resins, polyether, polyvinylacetate-based resins, polysurfone resins and polyurethane resins. These may be used either singly or in any combination thereof.

The thermoplastic resin may be one of the crystal resin having a melting point and the amorphous resin not having a melting point but having a glass transition point, or a mixture thereof.

<Softening Points of High Softening Point Clear Toner and Low Softening Point Clear Toner>

The present invention is characterized by satisfying the relationship of Tm(a)−Tm(b)>6° C., when the softening points of the high softening point clear toner and the low softening point clear toner are represented by Tm(a) and Tm(b), respectively. In particular, the relationship is preferably 15° C.>Tm(a)−Tm(b>10° C.

Since the high softening point clear toner and the low softening point clear toner satisfy Tm(a)−Tm(b)>6° C., that is, the difference in softening point between the two toners is larger than 6° C., the difference in gloss level between the obtained mat image part and gloss image part can be increased to a degree sufficient to surely recognize the difference. Accordingly, design features by the mat image part and the gloss image part can be ensured. Therefore, a highly recognizable watermark can be formed.

On the other hand, when the difference Tm(a)−Tm(b) in softening point between the high softening point clear toner and the low softening point clear toner is not larger than 6° C., the difference in gloss level between the obtained mat image part and gloss image part is too small to be recognized. Accordingly, the design features by the mat image part and the gloss image part cannot be obtained.

It is noted that when the difference Tm(a)−Tm(b) in softening point between the high softening point clear toner and the low softening point clear toner is not smaller than 15° C., there is a possibility in which the toner image for mat is not provided with sufficient fixability or in which a hot offset phenomenon occurs with respect to the low softening point clear toner constituting the toner image for gloss, when the toner image for mat and the toner image for gloss are heat fixed collectively, although the possibility depends on the temperature at heat-fixing.

Specifically, the softening point Tm(a) of the high softening point clear toner is preferably 80 to 140° C., more preferably 90 to 120° C., in view of fixability with the recording material P.

By setting the softening point Tm(a) of the high softening point clear toner in the above-described range, the mat image part can possess sufficient fixability. On the other hand, when the softening point of the high softening point clear toner is excessively high, there is a possibility in which low temperature fixability cannot be obtained. Also, when the softening point of the high softening point clear toner is excessively low, a low softening point clear toner having an excessively low softening point is to be used. Therefore, there is a possibility in which a hot offset phenomenon occurs with respect to the low softening point clear toner.

The softening point Tm(a) of the high softening point clear toner and the softening point Tm(b) of the low softening point clear toner are measured using a flow tester shown below.

Specifically, first, under an environment of 20° C. and 50% RH, 1.1 g of a measurement sample (a high softening point clear toner or a low softening point clear toner) is put in a petri dish and flattened, and left to stand for 12 hours or longer. Then, the sample is pressurized for 30 seconds with a force of 3,320 kg/cm$^2$ using a moiling machine "SSP-10A" (manufactured by Shimadzu Corporation) to prepare a column-shaped molded sample having a diameter of 1 cm. Next, this molded sample is extruded at the completion of preheating, under an environment of 24° C. and 50% RH, by a flow tester "CFT-500D" (manufactured by Shimadzu Corporation), under the conditions of a load of 196 N (20 kgf), a starting temperature of 60° C., a preheating time of 300 seconds, and a temperature increasing rate of 6° C./min, through a hole (1 mm in diameter×1 mm) of a column-shaped die, using a piston having a diameter of 1 cm. An offset method temperature $T_{offset}$ measured by the melting temperature measurement method of the temperature raising method at an offset value of 5 mm is determined as a softening point.

The softening points of the high softening point clear toner and the low softening point clear toner can be controlled by adjusting the type of a binder resin, the type and use ratio of raw materials for obtaining a binder resin, a molecular weight of a binder resin and the like.

As the total molecular weight of the binder resins constituting the high softening point clear toner and the low softening point clear toner, the number average molecular weight (Mn) is preferably 3,000 to 6,000, more preferably 3,500 to 5,500, and the ratio Mw/Mn of a weight average molecular weight (Mw) to a number average molecular weight (Mn) is 2.0 to 6.0, preferably 2.5 to 5.5.

The molecular weight of a binder resin constituting the high softening point clear toner and the low softening point clear toner is measured by gel permeation chromatography (GPC) of a tetrahydrofuran (THF) soluble component. Specifically, the measurement is performed in the following manner.

That is, using a machine "HLC-8220" (manufactured by Tosoh Corporation) and a column "TSK guard column+TSK gel Super HZM-M 3 series" (manufactured by Tosoh Corporation), tetrahydrofuran (THF) as a carrier solvent is flown at a flow rate of 0.2 ml/min while maintaining the column temperature at 40° C. By treating the measurement sample (each toner) using an ultrasonic disperser at room temperature for 5 minutes, the sample is dissolved in tetrahydrofuran so as to give a concentration of 1 mg/ml. Next, a treatment is performed using a membrane filter having a pore size of 0.2 μm to obtain a sample solution. Then, 10 μL of the sample solution is injected into the machine together with the above-described carrier solvent, and detection is performed using a refractive index detector (RI detector). Subsequently, the molecular weight distribution of the measurement sample is calculated using a calibration curve measured with monodispersed polystyrene standard particles. As a standard polystyrene sample for measuring the calibration curve, products manufactured by Pressure Chemical. Company having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ are used. At least approximately 10 standard polystyrene samples are measured to produce a calibration curve. As a detector, a refractive index detector is used.

<Average Particle Diameter of Toner>

Each of the high softening point clear toner and the low softening point clear toner preferably has an average particle diameter of 3 to 10 μm, more preferably 6 to 9 μm, in terms of a volume-based median diameter. The average particle diameters of the high softening point clear toner and the low softening point clear toner can be controlled by, for example, the concentration of an aggregating agent (a salting-out agent), a timing of adding a deaggregating agent, the temperature during aggregation, and the composition of a polymer, when the clear toners are produced by means of emulsion aggregation. By setting the volume-based median diameter to fall in the above-described range, transfer efficiency increases, and image quality of half tone is improved. Accordingly, image quality of thin lines, dots and the like is improved.

The volume-based median diameter of each of the high softening point clear toner and the low softening point clear toner is measured and calculated using a machine in which a computer system (manufactured by Beckman Coulter, Inc.) for data processing "Software V3.51" is connected to a "Coulter Counter Multisizer 3" (manufactured by Beckman Coulter, Inc.).

Specifically, 0.02 g of a measurement sample (a high softening point clear toner or a low softening point clear toner) is added to and blended with 20 mL of a surfactant solution (a surfactant solution in which a neutral detergent containing a surfactant component, for example, is diluted ten times with pure water, for the purpose of dispersion of a high softening point clear toner or a low softening point clear toner). Then, ultrasonic dispersion is performed for 1 minute to prepare a toner dispersion liquid. Thereafter, the toner dispersion liquid is poured using a pipet in a beaker containing an electrolytic solution "ISOTON II" (manufactured by Beckman Coulter, Inc.) placed on a sample stand, until the display concentration of a measurement machine becomes 5 to 10%. Here, with this concentration range, a reproducible measurement value can be obtained. In the measurement machine, the measurement particle count number is set at 25,000, the aperture diameter is set at 100 μm, and the measurement range of 2 to 60 μm is divided into 256 parts to calculate frequency values. The particle diameter (volume D50% diameter) at 50% from the larger volume cumulative fraction is determined as the volume-based median diameter.

<Coarse Particle Amount of High Softening Point Clear Toner and Low Softening Point Clear Toner>

In the image forming method according to the present invention, the amount of coarse particles having a particle diameter exceeding 10 μm of the high softening point clear toner and the low softening point clear toner is preferably not less than 0.01% by volume and not more than 5.0% by volume.

By setting the amount of coarse particles having a particle diameter exceeding 10 μm of the high softening point clear toner and the low softening point clear toner to be not more than 5.0% by volume, variations in transfer properties between the high softening point clear toner and the low softening point clear toner can be inhibited. Also, by setting the amount of coarse particles having a particle diameter exceeding 10 μm of the high softening point clear toner and the low softening point clear toner to be not less than 0.01% by volume, cleaning properties can be ensured. Furthermore, it is difficult in terms of manufacturing that the amount of coarse particles having a particle diameter exceeding 10 μm is made less than 0.01% by volume.

The amount of coarse particles having a particle diameter exceeding 10 μm of the high softening point clear toner and the low softening point clear toner is measured as described below.

Specifically, measurement and calculation are performed using a machine in which a computer system (manufactured by Beckman Coulter, Inc.) equipped with data processing software "Software V3.51" is connected to a "Coulter Counter Multisizer 3" (manufactured by Beckman Coulter, Inc.)

As a measurement procedure, 0.02 g of a measurement sample (a high softening point clear toner or a low softening point clear toner) is blended with 20 mL of a surfactant solution (a surfactant solution in which a neutral detergent containing a surfactant component, for example, is diluted ten times with pure water, for the purpose of dispersion of a toner). Then, ultrasonic dispersion is performed for 1 minute, to produce a toner dispersion liquid. The toner dispersion liquid is poured using a pipette in a beaker containing an "ISOTON II" (manufactured by Beckman Coulter, Inc.) placed on a sample stand, until the display concentration of a measurement machine becomes 5 to 10%. With the concentration falling in this range, a reproducible measurement value can be obtained. In the measurement machine, the measurement particle count number is set at 25,000, the aperture diameter is set at 100 μm, and the measurement range of 2.0 to 60 μm is divided into 256 parts to calculate frequency values. The ratio of the particles having a volume particle diameter of 10 μm or larger to the total particles is determined as the coarse particle amount.

<Average Circularity of Toner>

The average circularity of toner particles in each of the high softening point clear toner and the low softening point clear toner as described above is preferably 0.850 to 1.000, more preferably 0.900 to 0.995, in order to improve transfer efficiency.

By setting the average circularity to be in a range of 0.850 to 1.000, the packing density of toner particles in the toner image for gloss and the toner image for mat transferred onto the recording material P increases. Thus, fixability is improved, and fixing offset hardly occurs. Also, individual toner particles hardly fracture thereby decreasing contamination of a friction charge providing member. Thus, electrostatic propensity is stabilized.

The average circularity of each of the high softening point clear toner and the low softening point clear toner is a value measured using an "FPIA-2100" (manufactured by Sysmex Corporation). Specifically, the toner is blended with an aqueous solution containing a surfactant, and the obtained solution is subjected to an ultrasonic dispersion treatment for 1 minute for dispersion. Then, a picture is taken using the "FPIA-2100" (manufactured by Sysmex Corporation), under the conditions of the HPF (high magnification photographing) mode and the proper concentration of 3,000 to 10,000 in HPF detection number. The circularity of individual toner particle is calculated according to a formula (T) below. Then, the circularity of each toner particle is summed together, and the obtained value is divided by the total number of toner particles. The calculated value is determined as the average circularity. When the HPF detection number fails in the above-described range, reproducibility can be obtained.

Formula (T): Circularity=(Perimeter of circle having the same projected area as particle image)/(Perimeter of particle projection image)

<Production Process of High Softening Point Clear Toner and Low Softening Point Clear Toner>

As examples of the process of producing the high softening point clear toner and the low softening point clear toner as described above, may be mentioned a kneading and pulverizing method, a suspension polymerization method, an emulsion aggregation method, and other known methods. However, it is preferable that the emulsion aggregation method is used. According to the emulsion aggregation method, the particle diameter of the toner particles can be easily reduced, in view of manufacturing cost and manufacturing stability.

Here, the emulsion aggregation method is defined as a production method of a toner particle by aggregating binder resin fine particles produced by performing emulsification (hereinafter also referred to as "binder resin fine particles") in a water-based medium until a desired toner particle diameter is obtained, and further performing fusion among the binder resin fine particles to control a shape. Here, the binder resin fine particles may optionally contain internal additives such as a mold release agent and a charge control agent.

As the emulsification process of binder resins, may be mentioned an emulsion polymerization method, a mini-emulsion polymerization method, a seed polymerization method and a phase-transfer emulsification method. However, it is preferable that a polymerization method capable of forming toner particles only with water is adopted.

An example of a process of producing the high softening point clear toner and the low softening point clear toner using an emulsion aggregation method will be shown below.

(1) A step of preparing a dispersion liquid in which binder resin fine particles containing, as necessary, a mold release agent and a charge control agent are dispersed in a water-based medium (2) A step of aggregating and fusing the binder resin fine particles in the dispersion liquid to form toner particles (3) A step of filtering off the toner particles from a dispersion system of toner particles (a water-based medium) to remove a surfactant or the like (4) A step of drying the toner particles (5) A step of adding external additives in the toner particles The binder resin fine particles obtained in the above-described step (1) may have a multilayer structure including two or more layers each including a binder resin having a different composition. Regarding the binder resin fine particles having such a structure, when the emulsion polymerization method is used, for example, the binder resin fine particles having a two-layer structure can be obtained by a method of preparing a dispersion liquid of resin particles by a conventional emulsion polymerization treatment (first stage polymerization), adding a polymerization initiator and a polymerizable monomer in this dispersion liquid, and performing a polymerization treatment (second stage polymerization) of the obtained system.

Also, in the emulsion aggregation method, a toner particle having a core-shell structure can also be obtained. Specifically, the toner particle having a core-shell structure can be obtained by first aggregating and fusing binder resin fine particles for a core particle to produce a core particle; and then adding binder resin fine particles for a shell layer in the dispersion liquid of the core particle, and aggregating and fusing the binder resin fine particles for a shell layer on the surface of the core particle to form a shell layer that covers the surface of the core particle.

In the present invention, the "water-based medium" is defined as a medium including 50 to 100% by mass of water and 0 to 50% by mass of a water-soluble organic solvent. As examples of the water-soluble organic solvent, may be mentioned methanol, ethanol, isopropanol, butanol, acetone, methylethylketone and tetrahydrofuran. An alcohol-based organic solvent which does not dissolve the obtained resins is preferred.

<Chain Transfer Agent>

In the step of polymerizing binder resin fine particles, a commonly used chain transfer agent can be used for the purpose of adjusting the molecular weight of a binder resin. The chain transfer agent is not particularly limited. As examples of the chain transfer agent, may be mentioned 2-chloroethanol, mercaptan such as octylmercaptan, dodecylmercaptan and t-dodecylmercaptan, and styrene dimer.

<Polymerization Initiator>

In the step of polymerizing binder resin fine particles, an appropriate polymerization initiator for obtaining a binder resin can be used as long as the polymerization initiator is water-soluble. As concrete examples of the polymerization initiator, may be mentioned persulfate (such as potassium persulfate and ammonium persulfate), an azo-based compound (such as 4'4'-azobis 4-cyanovaleric acid and a salt thereof, 2'2'-azobis(2-aminopropane) salt), and a peroxy compound.

<Surfactant>

When a surfactant is used in the step of polymerizing binder resin fine particles, conventionally known various anionic surfactants, cationic surfactants, nonionic surfactants and the like can be used as the surfactant.

<Aggregating Agent>

As examples of an aggregating agent used in the step of polymerizing binder resin fine particles, may be mentioned alkali metal salts and alkali earth metal salts. As examples of the alkali metal constituting an aggregating agent, may be mentioned lithium, potassium and sodium. As examples of the alkali earth metal constituting an aggregating agent, may be mentioned magnesium, calcium, strontium and barium. Among these, potassium, sodium, magnesium, calcium and barium are preferred. As examples of a counter ion (an anion constituting a salt) of the alkali metal or the alkali earth metal, may be mentioned chloride ions, bromide ions, iodide ions, carbonic acid ions and sulfuric acid ions.

<Mold Release Agent>

When a mold release agent is contained in toner particles, as the mold release agent, may be preferably used oxidized polyethylene wax, polypropylene wax, oxidized polypropylene wax, carnauba wax, Sasol wax, rice wax, candelilla wax, jojoba oil wax and bees wax.

The content of the mold release agent is preferably 0.5 to 7% by mass, more preferably 0.5 to 5% by mass, in the toner particles.

A method of having the toner particles contain a mold release agent is not limited to a method of configuring binder resin fine particles as containing a mold release agent. There can also be used a method of adding a dispersion liquid in which mold release agent fine particles are dispersed in a water-based medium and salting out, aggregating and fusing the binder resin fine particles and the mold release agent fine particles, in the step of aggregating and fusing the binder resin fine particles to form toner particles. Also, these methods may be combined.

<Charge Control Agent>

When having the toner particles contain a charge control agent, known various kinds of compounds can be used as the charge control agent.

Specifically, oxycarboxylic acid complexes such as an salicylic acid complex and a benzilic acid complex may be mentioned. As examples of a center metal constituting the acid complex, may be mentioned aluminum, calcium and zinc. Also, besides the oxycarboxylic acid complexes, may be mentioned a quaternary ammonium salt compound, a nigrosine-based compound, azo complex dyes such as aluminum, iron and chromium, and a triphenylmethane-based pigment.

The content of a charge control agent is preferably 0.1 to 10% by mass, more preferably 0.5 to 5% by mass, in the toner particles.

The method of having the toner particles contain a charge control agent is not particularly limited, and may include, for example, a method similar to the method of having the toner particles contain a mold release agent shown above.

<External Additive>

Although the above-described toner particles can constitute the high softening point clear toner and the low softening point clear toner according to the present invention as they are, the toner according to the present invention may be constituted by adding in the toner particles an external additive such as a flow agent and a cleaning auxiliary agent which are so-called post-treatment agents, in order to improve flowability, electrostatic propensity, cleaning properties and the like.

As examples of the external additive, may be mentioned inorganic oxide fine particles including silica fine particles, alumina fine particles and titanium oxide fine particles, inorganic stearic acid compound fine particles such as aluminum stearate fine particles and zinc stearate fine particles, or inorganic titanic acid compound fine particles such as strontium titanate and zinc titanate. These can be used either singly or in any combination thereof.

Among these, silica fine particles are preferably used in view of the provision of flowability.

These inorganic fine particles are preferably subjected to a hydrophobization treatment using a silane coupling agent and a titanium coupling agent, as well as a higher fatty acid, silicone oil and the like.

The total added amount of these various kinds of external additives may be 0.05 to 5 parts by mass, preferably 0.1 to 3 parts by mass per 100 parts by mass of the toner. Also, various external additives may be used in combination.

<Surface Si Amount of High Softening Point Clear Toner and Low Softening Point Clear Toner>

In the image forming method according to the present invention, when each of the high softening point clear toner and the low softening point clear toner contains an external additive, the surface Si amount S(a) of the high softening point clear toner and the surface Si amount S(b) of the low softening point clear toner preferably satisfy a relationship of $S(a)<S(b)$.

By the fact that the surface Si amounts of the high softening point clear toner and the low softening point clear toner satisfy a relationship of $S(a)<S(b)$, the amount of the external additives present on each of the surfaces of the toner particles constituting the high softening point clear toner and the toner particles constituting the low softening point clear toner is appropriately adjusted so that transfer properties are substantially the same among all the toner particles. Therefore, equivalent transfer properties can be obtained between the toner image for mat and the toner image for gloss. As a result, even when an image having a different coverage rate is consecutively formed for an extended period of time, the difference in gloss level between the mat image part and the gloss image part can be stably obtained.

The surface Si amount of each of the high softening point clear toner and the low softening point clear toner is calculated by quantitatively analyzing elements of Si, Ti, O and C present on the surface of a measurement sample (a high softening point clear toner or a low softening point clear toner) simultaneously, using an X-ray analyzer "ESCA-1000" (manufactured by Shimadzu Corporation), according to the measurement condition described below, and by obtaining the ratio of an element (Si) corresponding to the surface Si amount to a total peak area ratio of 100%.

Measurement Condition

X-ray strength: 30 mA, 10 kV

Analysis depth: Normal mode

Quantitative element: Si, Ti, O and C

<Color Toner>

The color toner used in the image forming method according to the present invention may have a similar structure to that of the high softening point clear toner or the low softening point clear toner described above, except that the color toner positively contains a coloring agent.

That is, the color toner is defined as a toner containing a coloring agent that is intended to perform coloring by light absorption and light scattering.

As examples of the color toner, may be mentioned a yellow toner, a magenta toner, a cyan toner and a black toner. These may be used either singly or in any combination thereof.

<Coloring Agent>

As a coloring agent contained in the color toner, commonly known dyes and pigments may be used.

As a coloring agent for obtaining the black toner, may be optionally used publicly known various agents including carbon black such as furnace black and channel black, magnetic materials such as magnetite and ferrite, dyes, and inorganic pigments containing non-magnetic iron oxides.

As examples of a coloring agent for obtaining a color toner, may specifically be mentioned pigments such as C.I. pigment red 5, 48:1, 53:1, 57:1, 81:4, 122, 139, 144, 149, 166, 177, 178, 222, 238 and 269, C.I. pigment yellow 14, 17, 74, 93, 94, 138, 155, 180 and 185, C.I. pigment orange 13, 31 and 43, and C.I. pigment blue 15:3, 60 and 76; and dyes such as C.I. solvent red 1, 49, 52, 58, 68, 11 and 122, C.I. solvent yellow 19, 44, 77, 79, 81, 82, 93, 98, 103, 104, 112 and 162, and C.I. solvent blue 25, 36, 69, 70, 93 and 95.

The coloring agents for obtaining the toner of each color may be used either singly or in any combination thereof with respect to each color.

The number average primary particle diameter of these coloring agents in the toner particles varies depending on the type of a coloring agent or the like. However the number average primary particle diameter is preferably approximately 10 to 200 nm.

The content of a coloring agent is preferably 1 to 10% by mass, more preferably 2 to 8% by mass, in the toner. When the content of a coloring agent is less than 1% by mass, the coloring performance of the obtained toner may not be sufficient. On the other hand, when the content of a coloring agent in the toner exceeds 10% by mass, a liberation of a coloring agent or an attachment to a carrier may occur, thereby affecting electrostatic propensity.

As examples of a method of having the toner particles contain a coloring agent, may be mentioned a method of adding a dispersion liquid in which coloring agent fine particles are dispersed in a water-based medium and salting out, aggregating and fusing the binder resin fine particles and the coloring agent fine particles in the step of aggregating and fusing the binder resin fine particles to form toner particles when producing the color toner by the emulsion aggregation method; and a method of configuring binder resin fine particles as containing a coloring agent. Also, these methods may be combined.

<Softening Point of Color Toner>

When a colored image part is formed in the image forming method according to the present invention, a softening point Tm(c) of the color toner satisfies a relationship of $Tm(a)-3° C. > Tm(c) \geq Tm(b)$, more preferably $Tm(a)-3° C. > Tm(c) > Tm(b)+3° C.$, particularly preferably $Tm(a)-5° C. > Tm(c) > Tm(b)+5° C.$ By the fact that the softening points of the high softening point clear toner, the low softening point clear toner and the color toner satisfy the above-described relationship, the difference in gloss level among the obtained colored image part, gloss image part and mat image part can be increased to a degree sufficient to surely recognize the difference. Accordingly, design features by a colored image part, a mat image part and a gloss image part can be ensured.

The softening point Tm(c) of the color toner is measured in a similar manner to in the high softening point clear toner and the low softening point clear toner, except that a color toner is used as a measurement sample.

When using several types of color toners, the softening point Tm(c) of the color toner is determined to be the arithmetic mean value of the softening points of the color toners of respective colors measured in the above-described manner.

When using several types of color toners, the softening point is preferably less varied relative to the arithmetic average among the color toners of respective colors. The standard deviation of Tm(c) is preferably within 3° C., particularly preferably within 1° C.

The softening point of the color toner can be controlled by adjusting the type of a binder resin, the type and use ratio of raw materials for obtaining a binder resin, the molecular weight of a binder resin, and the like.

<Surface Si Amount of Color Toner>

In the image forming method, when the color toner contains an external additive, the surface Si amount S(c) of the color toner preferably satisfies a relationship of $S(c)\times0.95 < S(a) < S(b) < S(c)\times1.05$, more preferably $S(c)\times0.97 < S(a) < S(b) < S(c)\times1.03$.

By the fact that the surface Si amount of the color toner satisfies the above-described relational formula regarding the relationship with the surface Si amounts of the high softening point clear toner and the low softening point clear toner, the amount of an external additive present on the surfaces of the toner particles constituting the high softening point clear toner, the toner particles constituting the low softening point clear toner, and the toner particles constituting the color toner is appropriately adjusted so that transfer properties are substantially the same among all the toner particles. Therefore, equivalent transfer properties can be obtained among the toner image for gloss, the chromatic toner image and the toner image for mat. As a result, even when an image having a different coverage rate is consecutively formed for an extended period of time, the difference in gloss level between the mat image part and the colored image part, and the difference in gloss level between the colored image part and the gloss image part can be stably obtained.

The surface Si amount of the color toner is measured in a similar manner to the surface Si amount of the high softening point clear toner and the low softening point clear toner, except that the color toner is used as a measurement sample.

When using several types of color toners, the surface Si amount of the color toner is determined to be the arithmetic mean value of the surface Si amounts of the color toners of respective colors measured in the above-described manner.

When using several types of color toners, the surface Si amount is preferably less varied relative to the arithmetic average among the color toners of respective colors.

<Coarse Particle Amount of Color Toner>

In the image forming method, the amount of coarse particles having a particle diameter exceeding 10 μm of the color toner is preferably not less than 0.01% by volume and not more than 4.0% by volume.

By the fact that the amount of coarse particles having a particle diameter exceeding 10 μm of the color toner is not more than 4.0% by volume, variations in transfer properties between the high softening point clear toner and the color toner and between the low softening point clear toner and the color toner can be inhibited. Also, by the fact that the amount of coarse particles having a particle diameter exceeding 10 μm of the color toner is not less than 0.01% by volume, cleaning properties can be ensured. Furthermore, it is difficult in terms of manufacturing that the amount of coarse particles having a particle diameter exceeding 10 μm is made less than 0.01% by volume.

The amount of coarse particles having a particle diameter exceeding 10 μm of the color toner is measured in a similar manner to in the high softening point clear toner and the low softening point clear toner, except that the color toner is used as a measurement sample.

When using several types of color toners, the amount of coarse particles having a particle diameter exceeding 10 μm of the color toner is determined to be the arithmetic mean value of the coarse particle amounts of the color toners of respective colors measured in the above-described manner.

When using several types of color toners, the amount of coarse particles having a particle diameter exceeding 10 μm is preferably less varied relative to the arithmetic average among the color toners of respective colors.

<Developer>

Although the toner described above can be used as a magnetic or non-magnetic one-component developer, the toner may also be used as a two-component developer by mixing the toner with a carrier. When the toner is used as a two-component developer, as the carrier, may be used magnetic particles made of conventionally known materials including metal such as iron, ferrite and magnetite, and metal alloy of these metal and metal such as aluminum and lead. Particularly, ferrite particles are preferred. Also, as the carrier, may be used a coated carrier in which the surface of a magnetic particle is coated with a coating agent such as a resin, or a binder-type carrier in which magnetic substance fine powder is dispersed in a binder resin.

A coating resin constituting the coated carrier is not particularly limited. However, as examples of the coating resin, may be mentioned olefin-based resin, styrene-based resin, styrene acrylic resin, silicone-based resin, ester resin and fluorine resin. Also, a resin constituting the resin dispersion-type carrier is not particularly limited, and a publicly known resin can be used. For example, styrene acrylic resin, polyester resin, fluorine resin, phenol resin and the like can be used.

The volume-based median diameter of a carrier is preferably 20 to 100 μm, more preferably 20 to 60 μm. The volume-based median diameter of a carrier can be typically measured using a laser diffraction particle diameter distribution analyzer "HELOS" (manufactured by Sympatec GmbH) equipped with a wet disperser.

<Recording Material>

A recording material P used in the image forming method according to the present invention may be any recording material as long as it can retain the gloss image part, the mat image part and the colored image part. Specifically, as examples of the recording material, may be mentioned various kinds of paper such as plain paper ranging from thin to thick, high quality paper, coated printing paper such as art paper and coated paper, and various kinds of printing paper such as commercially available Japanese paper and postcard paper. However, the recording paper is not limited to these examples.

According to the image forming method described above, a plurality of image parts each having a different gloss level can be simultaneously formed by one heat-fixing by using the high softening point clear toner and the low softening point clear toner each having a different softening point. As a result, a printed matter with design features expressed by the plurality of image parts can be easily formed.

Although embodiments of the present invention have been described above, the embodiments of the present invention are not limited to these examples, and various modifications can be added thereto.

For example, in the image forming method of the above-described example, the intermediate transfer body having an endless belt shape and including an elastic layer has been described as an example. However, the intermediate transfer body is not limited to this example, and an intermediate transfer body having a roller shape and including an elastic layer can also be used.

EXAMPLES

Concrete examples of the present invention will be described below. However, the present invention is not limited to these examples.

It is noted that the softening points of the high softening point clear toner, the low softening point clear toner and the color toner were measured as described above.

<Preparation Example 1 of Resin Fine Particle Dispersion Liquid>

1. First-Stage Polymerization

In a reaction vessel equipped with a stirrer, a temperature sensor, a condenser and a nitrogen-introducing device, a surfactant solution in which 4 parts by mass of sodium polyoxyethylene(2)dodecyl ether sulfate was dissolved in 3,000 parts by mass of ion exchanged water was charged, and the internal temperature was raised to 80° C. while stirring the solution at a stirring speed of 230 rpm under nitrogen gas stream.

Into the surfactant solution, an initiator solution in which 4 parts by mass of a polymerization initiator (potassium persulfate: KPS) was dissolved in 200 parts by mass of ion exchanged water was added, and the liquid temperature was made at 75° C. Then a monomer mixed liquid including

| | |
|---|---|
| Styrene | 567 parts by mass |
| n-butyl acrylate | 165 parts by mass |
| Methacrylic acid | 68 parts by mass |

was added dropwise for 1 hour. The obtained system was heated and stirred at 75° C. for 2 hours to perform a polymerization (first-stage polymerization) reaction. Thus, a dispersion liquid (A1) in which resin fine particles (A1) were dispersed was prepared. The measured weight average molecular weight of the resin fine particles (A1) was 300,000.

2. Second-Stage Polymerization

In a reaction vessel equipped with a stirrer, a temperature sensor, a condenser and a nitrogen-introducing device, a surfactant solution in which 2 parts by mass of sodium polyoxyethylene(2)dodecyl ether sulfate was dissolved in 1,270 parts by mass of ion exchanged water was charged, and heated to 80° C. Then, the above-described dispersion liquid (A1) was poured in the solution in an amount of 40 parts by mass based on a solid content. Furthermore, a monomer solution in which a monomer mixed liquid including

| | |
|---|---|
| Styrene | 47 parts by mass |
| n-butyl acrylate | 47 parts by mass |
| Methacrylic acid | 15 parts by mass |
| n-octylmercaptan | 0.5 parts by mass |
| Wax "WEP-5" (manufactured by Nippon Oil & Fats Co., Ltd.) | 80 parts by mass |

was dissolved at 80° C. was added. The obtained product was mixed and dispersed for 1 hour using a mechanical disperser "Clear mix" (manufactured by M Technique Co., Ltd.) having a circulation path. Thus, a dispersion liquid containing emulsified particles was prepared.

Subsequently, into this dispersion liquid, an initiator solution in which 6 parts by mass of potassium persulfate was dissolved in 100 parts by mass of ion exchanged water was added. This system was heated and stirred at 80° C. for 1 hour to perform a polymerization (second-stage polymerization) reaction. Thus, a dispersion liquid (A2) in which resin fine particles (A2) were dispersed.

3. Third-Stage Polymerization

Into the above-described dispersion liquid (A2), an initiator solution in which 10 parts by mass of potassium persulfate was dissolved in 200 parts by mass of ion exchanged water was added. Under the temperature condition of 80° C., a monomer mixed liquid including

| | |
|---|---|
| Styrene | 386 parts by mass |
| n-butyl acrylate | 140 parts by mass |
| Methacrylic acid | 45 parts by mass |
| n-octylmercaptan | 13 parts by mass |

was added dropwise for 1 hour. After the dropwise addition was completed, the obtained product was heated and stirred for 2 hours to perform a polymerization (third-stage polymerization) reaction. Thereafter, the reaction liquid was cooled to 28° C. Thus, there was obtained a resin fine particle dispersion liquid (1) in which resin fine particles (1) including composite resin fine particles were dispersed.

<Preparation Example 1 of Clear Toner>

In a reaction vessel, equipped with a stirrer, a temperature sensor, a condenser and a nitrogen-introducing device, 450 parts by mass of the resin fine particle dispersion liquid (1) based on a solid content, 1,100 parts by mass of ion exchanged water, and 2 parts by mass of sodium dodecylsulfate were poured and stirred. The temperature in the reaction vessel was adjusted to 30° C. Then, a 5 mol/L aqueous sodium hydroxide solution was added to adjust the pH to 10.

Subsequently, an aqueous solution in which 70 parts by mass of magnesium chloride hexahydrate was dissolved in 75 parts by mass of ion exchanged water was added under stirring in the obtained product at 30° C. for 10 minutes. The resultant product was allowed to stand for 3 minutes, and then the temperature started to be raised. The temperature of the obtained system was raised to 85° C. for 60 minutes, to continue the aggregation and fusion of the resin fine particles (i) while the temperature was held at 85° C. In this state, the particle diameter of the formed aggregated particles was measured using a "Multisizer 3" (manufactured by Beckman Coulter, Inc.). At the time the volume-based median diameter of the aggregated particles reached 6.7 μm, an aqueous solution in which 200 parts by mass of sodium chloride was dissolved in 860 parts by mass of ion exchanged water was added to terminate the aggregation.

After the aggregation was terminated, an aging treatment, in which the liquid temperature was set at 98° C. and the resultant product was heated and stirred for 8 hours, was performed to proceed with the fusion among fine particles of the aggregated particles. Thus, toner base particles (1) were formed. After the aging treatment, the liquid temperature was cooled to 30° C. Then, the pH in the liquid was adjusted to 2 with hydrochloric acid, and stirring was terminated.

The obtained toner base particles (1) were separated into solid and liquid using a basket-type centrifugal separator "MAPK III model No. 60×40" (manufactured by Matsumoto Machine Co., Ltd.), to form a wet cake of the toner base particles (1). The wet cake was washed with ion exchanged water at 40° C. using the basket-type centrifugal separator until the electric conductivity of the filtrate reached 5 μS/cm. Thereafter, the washed wet cake was transferred into a "Flash jet dryer" (manufactured by Seishin Enterprise Co., Ltd.), and a drying treatment was performed until water content reached 0.5% by mass. Thus, the toner base particles (1) were obtained.

In 100 parts by mass of the toner base particles (1), an external additive consisting of 1.0 parts by mass of silica treated with hexamethylsilazane (average primary particle diameter: 12 nm, hydrophobization degree: 68) and 0.3 parts by mass of titanium dioxide treated with n-octyisilane (average primary particle diameter: 20 nm, hydrphobization degree: 63) were added. An external addition treatment was performed using a Henschel mixer (manufactured by Mitsui-Miike Mining Co., Ltd.). Thus, a clear toner (1) was prepared. The external addition treatment by the Henschel mixer was performed under the conditions of a peripheral speed of a stirring blade of 35 m/s, a treatment temperature of 35° C., and a treatment time of 18 minutes.

The softening point of the clear toner (1) is shown in Table 1.

<Preparation Examples 2 to 8 of Clear Toners>

Clear toners (2) to (8) were prepared in a similar manner to in Preparation example 1 of a clear toner, except that a resin fine particle dispersion liquid obtained by adding styrene (St) and methacrylic acid (MAA) in an amount according to the formulation in Table 1 in the second-stage polymerization of Preparation example 1 of a resin fine particle dispersion liquid was used instead of the resin fine particle dispersion liquid (1), and the treatment time of an external, addition treatment on the toner base particles was changed in accordance with Table 1. The softening points of the clear toners (2) to (8) are shown in Table 1. In Preparation example 7 of a clear toner, at the time the volume-based median diameter of the aggregated particles reached 7.7 μm, an aqueous sodium chloride solution was added to terminate the aggregation.

TABLE 1

| CLEAR TONER NO. | SOFTENING POINT (° C.) | COMPOSITION St PARTS BY MASS | COMPOSITION MAA PARTS BY MASS | MIXING TIME DURING EXTERNAL ADDITION TREATMENT (MIN.) |
|---|---|---|---|---|
| [1] | 111.1 | 47 | 15 | 18 |
| [2] | 102.8 | 62 | 2 | 12 |
| [3] | 112.1 | 45 | 17 | 19 |
| [4] | 101.8 | 62 | 0 | 11 |
| [5] | 109.3 | 48 | 14 | 15 |
| [6] | 103.2 | 59 | 3 | 15 |
| [7] | 111.1 | 47 | 15 | 15 |
| [8] | 111.1 | 47 | 15 | 21 |

<Preparation Examples 1 to 8 of Clear Developers>

Each of the clear toners (1) to (8) was mixed with a ferrite carrier having a volume-based median diameter of 35 μm and including a silicone resin coated thereon, using a V-type mixer so as to give a toner concentration of 6% by mass. Thus, clear developers (1) to (8) were prepared.

Examples 1 to 9 and Comparative Example 1

A digital copier "bizhub PRO C6500" (manufactured by Konica Minolta Business Technologies, Inc.) was modified so that two clear toner image formation parts and color toner image formation parts of YMCK were arranged as shown in FIG. 1. The condition of a fixing device was changed to 200° C. Using the clear developers (1) to (8) in combination according to Table 2 and a commercially available cyan toner usable in the above-described digital copier "bizhub PRO C6500", 10,000 pieces of solid patches having a toner attachment amount of 4 g/m$^2$ and a coverage rate of 5% were formed for each toner. Then, sample images shown in FIG. 2 (defined as printed matters (1) to (10)) were formed. Thereafter, for a clear toner, 10,000 pieces of solid patches having a coverage rate of 100% were formed; and for a cyan toner, 10,000 pieces of solid patches having a coverage rate of 10% were formed. Then, sample images shown in FIG. 2 (defined as printed matters [1X] to [10X]) were formed.

Figure 2:
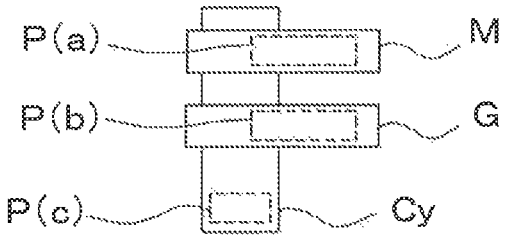
FIG. 2 is a schematic view illustrating a sample image to be formed in Examples and Comparative Examples.

In FIG. 2, M indicates a mat image part formed with a high softening point clear toner; G indicates a gloss image part formed with a low softening point clear toner; and Cy indicates a colored image part formed with a cyan toner.

colored image part were not smaller than 3, and when the difference in gloss level between a mat image part and a gloss image part was not smaller than 6, the gloss level was determined to be passed. When both of the difference in gloss level between a mat image part and a colored image part and the difference in gloss level between a gloss image part and a colored image part were not smaller than 5, the gloss level was determined to be especially superior. Also, when the difference in gloss level between a mat image part and a gloss image part was not smaller than 10, the gloss level was determined to be especially superior.

TABLE 2

| | | | SOFTENING POINT | | | | |
|---|---|---|---|---|---|---|---|
| | HIGH SOFTENING POINT CLEAR TONER NO. | LOW SOFTENING POINT CLEAR TONER NO. | HIGH SOFTENING POINT CLEAR TONER Tm(a) | COLOR TONER Tm(c) (° C.) | LOW SOFTENING POINT CLEAR TONER Tm(b) | Tm(a) − Tm(b) | Tm(a) − 3-Tm(c) |
| EXAMPLE 1 | [1] | [2] | 111.1 | 107 | 102.8 | 8.3 | 1.1 |
| EXAMPLE 2 | [3] | [4] | 112.1 | 107 | 101.8 | 10.3 | 2.1 |
| EXAMPLE 3 | [3] | [4] | 112.1 | 107 | 101.8 | 10.3 | 2.1 |
| EXAMPLE 4 | [1] | [2] | 111.1 | 107 | 102.8 | 8.3 | 1.1 |
| EXAMPLE 5 | [1] | [2] | 111.1 | 107 | 102.8 | 8.3 | 1.1 |
| EXAMPLE 6 | [5] | [6] | 109.3 | 107 | 103.2 | 6.1 | −0.7 |
| EXAMPLE 7 | [8] | [2] | 111.1 | 107 | 102.8 | 8.3 | 1.1 |
| EXAMPLE 8 | [8] | [2] | 111.1 | 107 | 102.8 | 8.3 | 1.1 |
| EXAMPLE 9 | [7] | [6] | 111.1 | 107 | 103.2 | 7.9 | 1.1 |
| COMPARATIVE EXAMPLE 1 | [3] | [1] | 112.1 | 107 | 111.1 | 1.0 | 2.1 |

| | SURFACE Si AMOUNT | | | COARSE PARTICLE AMOUNT | | | |
|---|---|---|---|---|---|---|---|
| | HIGH SOFTENING POINT CLEAR TONER S(a) | COLOR TONER S(c) | LOW SOFTENING POINT CLEAR TONER S(b) | HIGH SOFTENING POINT CLEAR TONER | COLOR TONER | LOW SOFTENING POINT CLEAR TONER | ELASTIC LAYER |
| | | | | (% BY VOLUME) | | | |
| EXAMPLE 1 | 3060 | 3000 | 3140 | 3.00 | 0.19 | 0.15 | ABSENT |
| EXAMPLE 2 | 3100 | 3000 | 3140 | 3.00 | 0.19 | 0.19 | ABSENT |
| EXAMPLE 3 | 3100 | 3000 | 3080 | 3.00 | 0.19 | 0.19 | ABSENT |
| EXAMPLE 4 | 3060 | 3000 | 3080 | 3.00 | 0.19 | 0.15 | ABSENT |
| EXAMPLE 5 | 3060 | 3000 | 2700 | 3.00 | 0.19 | 0.15 | ABSENT |
| EXAMPLE 6 | 3160 | 3000 | 2700 | 3.00 | 0.19 | 6.00 | ABSENT |
| EXAMPLE 7 | 3180 | 3000 | 3010 | 3.00 | 0.19 | 0.15 | ABSENT |
| EXAMPLE 8 | 3180 | 3000 | 3010 | 3.00 | 0.19 | 0.15 | ABSENT |
| EXAMPLE 9 | 3160 | 3000 | 3010 | 6.00 | 0.19 | 6.00 | ABSENT |
| COMPARATIVE EXAMPLE 1 | 3100 | 3000 | 3060 | 3.00 | 0.19 | 3.00 | ABSENT |

<Evaluation 1: Difference in Gloss>

The gloss levels of an observation region P(a), an observation region P(b) and an observation region P(c) on each of the printed matters (1) to (10) obtained as described above were measured. Based on the difference among the measured gloss levels, visibility was evaluated. Also, visual evaluation of the difference in gloss on each of the printed matters (1) to (10) was performed in accordance with the evaluation criteria below.

Specifically, the gloss levels were measured using a gloss meter "GMX-203" (manufactured by Murakami Color Research Laboratory) at a measurement angle of 20° based on the "JIS Z8741 1983 Method 2". The average value of the values measured at 5 points of a center part and four corners of each observation region on a printed matter was determined as the gloss level.

When both the difference in gloss level between a mat image part and a colored image part by a cyan toner and the difference in gloss level between a gloss image part and a It is noted that when the difference in gloss level between a mat image part and a colored image part or the difference in gloss level between a gloss image part and a colored image part is not smaller than 3, it is considered that the difference can be visually determined.

In the visual evaluation, observation was performed under two environments of illuminances of 1,000 lux and 200 lux, both adjusted by a fluorescent light.

—Evaluation Criteria—

A: Recognizable under an illuminance of 200 lux (Passed)

B: Less recognizable under an illuminance of 200 lux, but recognizable under an illuminance of 1,000 lux (Passed)

D: Unrecognizable even under an illuminance of 1,000 lux (Failed)

<Evaluation 2: Gloss Variation>

With respect to the printed matters (1) to (10) and (1X) to (10X) obtained as described above, evaluation was performed according to the evaluation criteria below on whether or not haze-like gloss variation of an image can be visually recognized. The results are shown in Table 3.

—Evaluation Criteria—

A: No gloss variation was recognized (Passed).

B: Only small gloss variation was recognized (Passed).

C: Gloss variation was recognized, but to a degree not causing a problem in practical use (Passed).

D: Gloss variation was clearly recognized, and did not fit for practical use (Failed).

TABLE 3

| | DIFFERENCE IN GLOSS | | | | GLOSS VARIATION | |
|---|---|---|---|---|---|---|
| | VISUAL EVALUATION | GLOSS LEVEL P (a) | P (c) | P (b) | AFTER PRINTING 10,000 PIECES | AFTER PRINTING 20,000 PIECES |
| EXAMPLE 1 | A | 54 | 60 | 67 | A | A |
| EXAMPLE 2 | A | 50 | 60 | 72 | A | A |
| EXAMPLE 3 | B | 50 | 60 | 72 | A | A |
| EXAMPLE 4 | A | 54 | 60 | 67 | A | A |
| EXAMPLE 5 | B | 54 | 60 | 67 | A | A |
| EXAMPLE 6 | B | 57 | 60 | 63 | B | C |
| EXAMPLE 7 | B | 54 | 60 | 67 | B | B |
| EXAMPLE 8 | B | 54 | 60 | 67 | B | B |
| EXAMPLE 9 | B | 54 | 60 | 63 | B | B |
| COMPARATIVE EXAMPLE 1 | D | 50 | 60 | 51 | D | D |

REFERENCE SIGNS LIST

10 Intermediate transfer part
11Hm, 11Hg, 11Y, 11M, 11C, 11Bk Photoreceptor
12 Cleaning unit
13Hm, 13Hg, 13Y, 13M, 13C, 13Bk Primary transfer roller
13A Secondary transfer roller
16 Intermediate transfer body
16*a* to 16*d* Support roller
20Hg Gloss clear toner image forming part
20Hm Mat clear toner image forming part
20Y, 20M, 20C, 20Bk Color toner image forming part
21Hm, 21Hg, 21Y, 21M, 21C, 21Bk Developing unit
22Hm, 22Hg, 22Y, 22M, 22C, 22Bk Exposing unit
23Hm, 23Hg, 23Y, 23M, 23C, 23Bk Electric charging unit
25Hm, 25Hg, 25Y, 25M, 25C, 25Bk Cleaning unit
26 Fixing device
41 Paper feeding cassette
42 Paper feeding and delivering unit
44*a*, 44*b*, 44*c*, 44*d* Paper feeding roller
46 Resist roller
P Recording material

The invention claimed is:

1. An image forming method comprising:

a developing step of developing an electrostatic latent image for a high softening point clear toner and an electrostatic latent image for a low softening point clear toner both being formed on an electrostatic latent image carrier, using a high softening point clear toner and a low softening point clear toner each having a different softening point, to form a toner image by the high softening point clear toner and a toner image by the low softening point clear toner;

a transferring step of transferring the toner image by the high softening point clear toner and the toner image by the low softening point clear toner onto a recording material via an intermediate transfer body to form a toner image for low gloss and a toner image for high gloss; and a fixing step of collectively heat-fixing the toner image for low gloss and the toner image for high gloss on the recording material, wherein a softening point Tm(a) of the high softening point clear toner and a softening point Tm(b) of the low softening point clear toner satisfy a relational formula (1) below:

$$Tm(a)-Tm(b)>6^\circ\ \text{C.} \qquad \text{Relational formula (1):}$$

2. An image forming method comprising:

a developing step of developing an electrostatic latent image for a high softening point clear toner, an electrostatic latent image for a low softening point clear toner, and an electrostatic latent image for a color toner all being formed on an electrostatic latent image carrier, using a high softening point clear toner, a low softening point clear toner and a color toner each having a different softening point, to form a toner image by the high softening point clear toner, a toner image by the low softening point clear toner, and a toner image by the color toner;

a transferring step of transferring the toner image by the high softening point clear toner, the toner image by the low softening point clear toner, and the toner image by the color toner onto a recording material via an intermediate transfer body, to form a toner image for low gloss, a toner image for high gloss, and a chromatic toner image; and a fixing step of collectively heat-fixing the toner image for low gloss, the toner image for high gloss, and the chromatic toner image on the recording material, wherein a softening point Tm(a) of the high softening point clear toner, a softening point Tm(b) of the low softening point clear toner, and a softening point Tm (c) of the color toner satisfy relational formulae (1) and (2) below:

$$Tm(a)-Tm(b)>6^\circ\ \text{C.} \qquad \text{Relational formula (1):}$$

$$Tm(a)-3^\circ\ \text{C.}>Tm(c)\geq Tm(b). \qquad \text{Relational formula (2):}$$

3. The image forming method according to claim 2, wherein in the transferring step the toner image by the low softening point clear toner, the toner image by the high softening point clear toner, and the toner image by the color toner are transferred on the intermediate transfer body in this order.

4. The image forming method according to claim 1, wherein each of the high softening point clear toner and the low softening point clear toner contains an external additive, and a surface Si amount S(a) of the high softening point clear toner and a surface Si amount 3 (b) of the low softening point clear toner satisfy a relational formula (3) below:

$S(a)<S(b)$. Relational formula (3):

5. The image forming method according to claim 2, wherein each of the high softening point clear toner and the low softening point clear toner contains an external additive, and a surface Si amount S(a) of the high softening point clear toner and a surface Si amount S(b) of the low softening point clear toner satisfy a relational formula (3) below:

$S(a)<S(b)$. Relational formula (3):

6. The image forming method according to claim 5, wherein a surface Si amount S(c) of the color toner satisfies a relational formula (4) below:

$S(c)\times 0.95<S(a)<S(b)<S(c)\times 1.05$. Relational formula (4):

7. The image forming method according to claim 1, wherein an amount of coarse particles having a particle diameter exceeding 10 μm in each of the high softening point clear toner and the low softening point clear toner is not less than 0.01% by volume and not more than 5.0% by volume.

8. The image forming method according to claim 2, wherein an amount of coarse particles having a particle diameter exceeding 10 μm in each of the high softening point clear toner and the low softening point clear toner is not less than 0.01% by volume and not more than 5.0% by volume.

9. The image forming method according to claim 8, wherein an amount of coarse particles having a particle diameter exceeding 10 μm in the color toner is not less than 0.01% by volume and not more than 4.0% by volume.

10. The image forming method according to claim 1, wherein the heat-fixing is performed at a heating temperature of Tm(a)+80° C. to Tm(a)+100° C. in the fixing step.

11. The image forming method according to claim 2, wherein the heat-fixing is performed at a heating temperature of Tm(a)+80° C. to Tm(a)+100° C. in the fixing step.

12. The image forming method according to claim 1, wherein the intermediate transfer body has a base and an elastic layer formed on the base.

13. The image forming method according to claim 2, wherein the intermediate transfer body has a base and an elastic layer formed on the base.

14. The image forming method according to claim 12, wherein the elastic layer includes at least a thermoplastic elastomer and an electrically conductive substance dispersed in the thermoplastic elastomer.

15. The image forming method according to claim 13, wherein the elastic layer includes at least a thermoplastic elastomer and an electrically conductive substance dispersed in the thermoplastic elastomer.

* * * * *